United States Patent [19]

Schmucker et al.

[11] 4,156,517

[45] May 29, 1979

[54] BEAM FORM

[75] Inventors: Erwin Schmucker, Schelklingen; Karl Rampf, Erbach, both of Fed. Rep. of Germany

[73] Assignee: Rampf KG Formen, Allmendingen, Fed. Rep. of Germany

[21] Appl. No.: 768,012

[22] Filed: Feb. 11, 1977

[30] Foreign Application Priority Data

Feb. 14, 1976 [DE] Fed. Rep. of Germany 760427

[51] Int. Cl.[2] ..... B28B 7/02

[52] U.S. Cl. ..... 249/161; 249/50; 249/169

[58] Field of Search ..... 249/50, 155, 161, 168, 249/169, 219 R; 425/441

[56] References Cited

U.S. PATENT DOCUMENTS 3,168,771 2/1965 Nelson ..... 249/161

3,645,490 2/1972 Beasley ..... 249/50

3,704,852 12/1972 Wellander ..... 249/155

FOREIGN PATENT DOCUMENTS 2356288 5/1975 Fed. Rep. of Germany ..... 249/50

*Primary Examiner*—Roy Lake

*Assistant Examiner*—John McQuade

*Attorney, Agent, or Firm*—George R. Douglas, Jr.; Anthony D. Cennamo

[57] ABSTRACT

Block-forming means or shuttering apparatus for precast units of especially long dimension along one axis, a horizontal basic frame and two block-forming or shuttering walls of which are means for at least one is guided slidably being selectively adjustable along the basic frame to change the mutual distance between the two shuttering walls, piston and cylinder assemblies 16 for driving of said sliding guided means, and clamping means 19 for clamping together one of the slidable shuttering walls and the basic frame.

7 Claims, 8 Drawing Figures

BEAM FORM

BRIEF SUMMARY OF THE INVENTION

The invention relates to shuttering apparatus specially for long precast concrete units comprising a horizontal basic frame and two shuttering walls of which at least one is a slidably guided unit and is indefinitely without steps, optionally adjustable on the basic frame to change the mutual distance of the shuttering walls. Such precast concrete units may come to include but not limited to trusses, girders, columns and so forth, and also staircases.

BACKGROUND OF THE INVENTION

The invention particularly is an improved shutttering apparatus over the kind known from DT-GM No. 73 44 616, A German Patent Publication; there the shuttering walls are moved by means of a geared drive, the driving shaft of which extends parallel to the longitudinal direction of the precast concrete unit. However, in order to counteract the concrete pressure when casting precast concrete units and to secure the shuttering walls from sliding back, in the known shuttering there are necessary additional support devices which are fitted with threaded spindles. These have to be placed individually before each cast and have to be tightened by hand as well as be loosened and removed after each cast.

It has been found that particularly in very large and high shutterings, this kind of construction is quite satisfactory. The clearance of the sliding guide at the basic frame which is necessary for a sufficient easy mobility of the movable shuttering wall makes an exact adjustment of the shuttering wall distance in the upper range practically impossible, because when casting there are enormous forces affecting the shuttering walls and the mentioned clearance the more becomes effective inclining the shuttering wall against an exact vertical position, the higher shuttering walls being in comparison to their support basis. In addition comes the intricate handling of a spindle support devices which result in loss of time and high wage costs.

FIELD OF THE INVENTION

The advantage and object of the invention is to simplify the handling of such shutterings and to improve their dimensional stability particularly at high shuttering walls. Proceeding from a shuttering of the kind which is detailed above, the problem is solved according to the invention in such a way that piston and cylinder assemblies for the drive of the sliding movement and clamping devices for clamping the slidable shuttering wall on the basic frame are provided. The sliding piston and cylinder assemblies act at the slidable shuttering wall in the range of the bottom edge and extend themselves horizontally and transverse to the longitudinal direction of the shuttering beneath the encased precast concrete unit. The clamping devices are preferably also operated by means of preferably hydraulic piston and cylinder assemblies, so-called clamping cylinders. For this purpose may, however, also be employed mechanical clamping elements, for instance such with electrical individual drive. In case of clamping cylinders these are made pressureless for sliding and then during casting and hardening of the concrete they are set under pressure.

Further is proposed by the invention that for the clamping cylinder is provided a pressure reservoir.

Despite leakages or symptoms of fatigue at the sealings which never can be avoided completely, this reservoir makes it possible to maintain the clamping force at least for instance for three hours, until the concrete has hardened.

The automatic particularly fully hydraulic drive of such a shuttering shortens the non-productive time and thus increases the labor efficiency, saves personnel and facilitates handling and ease of operation. Beyond that also results a constructive facilitation of according to a further proposal of the invention the basic frame comprises several parallel transverse girders and the slidable shuttering with its supports is arranged on horizontal slide skids, which connect the bottom edge of the shuttering with the bottom ends of the supports and further the slide skids lie parallely on the transverse girders and are guided slidable in their longitudinal direction on these girders by means of fingers gripping beneath and behind the upper transverse flange of the I-profile of the girder. It has been found that it is sufficient to install at the slide skids only one clamping device each. Particularly it is proposed, to arrange this clamping device near to the end of the shuttering wall side of the slide skid. The clamping force is indeed most effective at this place or point as the slide skid at this end wants to lift on account of the horizontal tilting forces effecting the shuttering wall. In return, however, the guide arrangement at the support side end of the slide skid may be executed accordingly simple, because there are occuring only thrust forces and no tension forces at least in clamping position.

Considering one form of a single clamping device, this comprises preferably one ring frame which encloses the transverse girder, the appertaining slide skid and the lifting piston and cylinder assembly of short stroke, which is fastened to the frame, whereby the piston of the lifting cylinder shows a pressure plate. This clamping device preferably is fastened at the slide skid. The lifting cylinder may be mounted above it or underneath the transverse girder, so that it presses either on the slide skid or from beneath onto the transverse girder. In order that the clamping device can also take up essentially highest horizontal pushing forces, it is further proposed that a pressure plate shows an area which is provided with a relief design consisting of projecting parts, for instance with points or cutters. Thereby this area, in dependance on the maximum lifting force of the lifting cylinder is to be calculated thus respectively the number of points has to be chosen thus, that the points are allowed to press into the metal surface to which the pressure plates lies close by making allowance for an appropriate lasting deformation. It is thus not only intended a very high surface pressing at the clamping point but in the mentioned extent even a mutual interconnection by shape.

In order to be able to use rather short slide piston and cylinder assemblies despite the big stroke which is necessary when the shuttering is prepared for a concrete unit of another shape and with other dimensions again, it is proposed in addition that these assemblies have and parts which are attachable by choice in different longitudinal positions at the transverse girders. In this way it is namely sufficient when the maximum stroke of these slide piston and cylinder assemblies correspond in principle only to the stroke for which the shuttering has to be opened to remove the concrete unit. For further sliding apart respectively sliding together of the shuttering walls, which is only necessary when changing to another precast concrete unit, the end parts may be removed step by step.

BRIEF DESCRIPTION OF THE DRAWINGS

The above and other objects and advantages of the invention will become apparent upon full consideration of the following detailed description and accompanying drawings in which.

DETAILED DESCRIPTION OF THE PREFERRED EMBODIMENTS OF THE INVENTION

Figure 1:
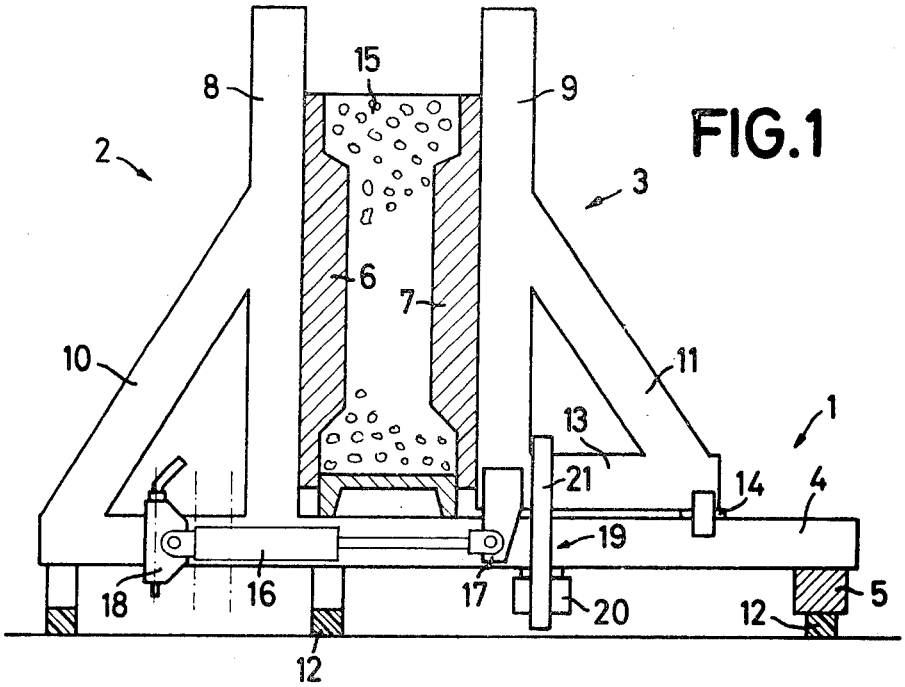
FIG. 1—A schematic cross-section of a binder shuttering according to a preferred embodiment of the invention.

Referring now to the drawings, there is shown a block-forming means or binder shuttering apparatus according to FIG. 1 consisting of a basic frame 1 and two shuttering walls 2 and 3. The basic frame comprises several transverse girders 4 and a longitudinal girder 5, the shuttering walls comprise each one shuttering plates 6, 7, columns 8, 9 and supports 10, 11. The left shuttering wall 2 is connected solidly with the transverse girder 4 and thus connects said girders 4 also between each other in a longitudinal direction. At the right end the transverse girders 4 are lying on the longitudinal girder 5, which also connects them solidly between each other. Rubber-bonded-to-metal elements 12 give the basic frame 1 the necessary vibration movability for shaking. The columns 9 of the right shuttering wall form an angle construction with the slide skids 13 which are fixed at the lower ends of them at right angles and are supported in the vertical position by means of the supports 11. The slide skids 13 lie parallely on the transverse girders 4 with slide plates 14 in intermediate position and are guided along the girders slidably in a longitudinal direction.

In order to remove the concrete binder 15 the right shuttering wall 3 is slid to the right side and before the casting of the next binder, it is slid back into the position shown. As a drive for it serves the piston and cylinder assemblies called hereafter, slide cylinders 16 which act each with one end on an appendix 17 fastened at the right shuttering wall and directed to the bottom and with the other end on an end part 18, which may be moved step-by-step in the direction of the transverse girder 4.

In order to retain the right shuttering wall 3 in the immovably drawn position, at each slide skid 13 in the proximity of the respective column 9 there is mounted a clamping device 19 which contains a vertical short stroke strong lifting cylinder or clamping cylinder 20 and in principle consists of a ring frame 21 which clamps around this clamping cylinder 20, the transverse girder 4 and the slide skid 13.

Figure 2:
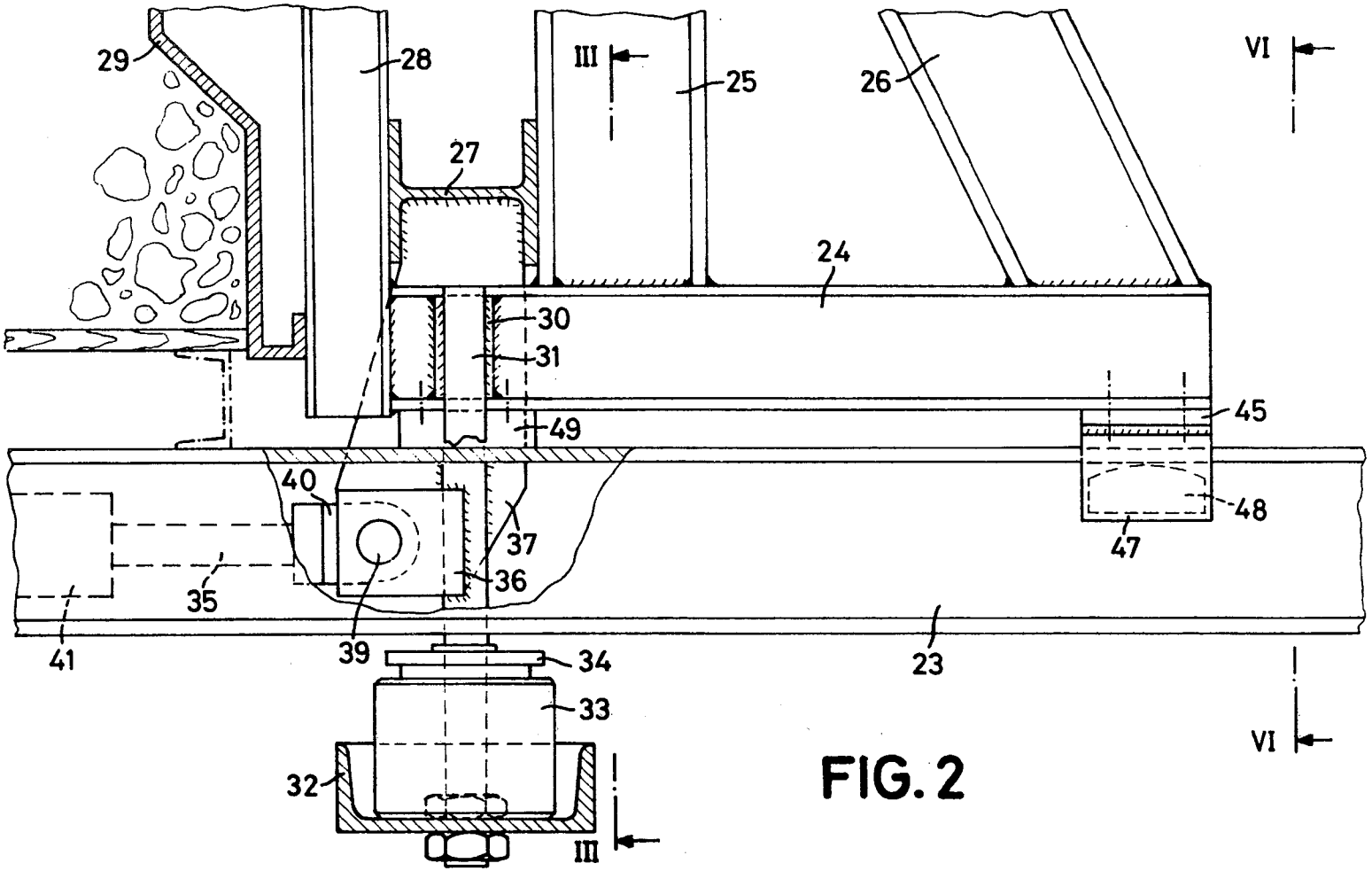
FIG. 2—Shows an enlarged detail of a cross-sectional view of a shuttering.
Figure 3:
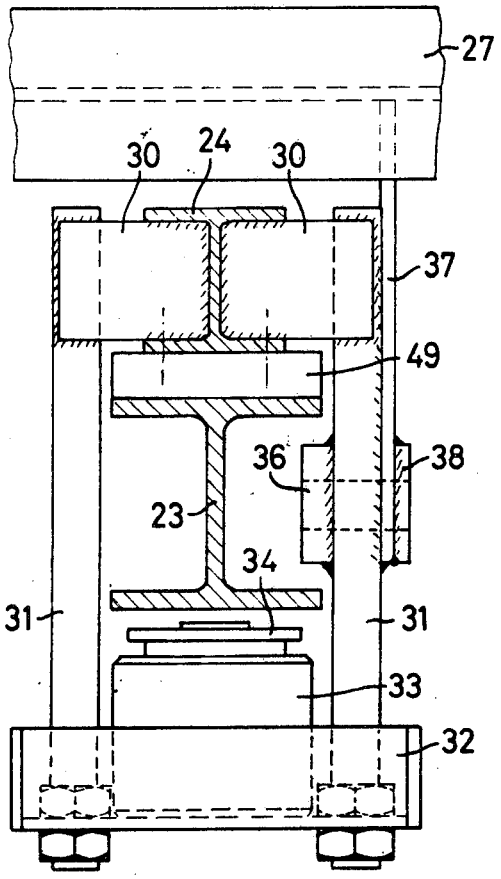
FIG. 3—Shows a clamping arrangement taken along the line III—III of FIG. 2, and partly cut away.

FIGS. 2 and 3 show in detail a clamping arrangement which generally is the same as described above. A transverse girder 23 is an I-beam or profile girder with a height of 180 mm, the slide skid 24 is an I-beam girder with a height of 120 mm. The shuttering wall consists of vertical main columns 25 and supports 26, horizontal girders 27 and a larger number of thinner vertical intermediate columns 28, which support the special shuttering insert 29. The frame of the clamping device consists of two transverse tabs 30 welded into the slide skid 24, two vertical longitudinal posts 31, which are quadratic in cross-section and are provided at the lower end with a thread, and with a tub-like lower transverse connecting part 32, which is screwed together with the longitudinal posts 31. In the tub-like transverse connecting part 32 there is mounted the clamping cylinder 33 with its plate-like pressure piece 34 which is turned towards the transverse girder 23.

For connecting the piston rod 35 of the slide cylinder with the longitudinal post 31 which is located according to FIG. 2 at the rear respectively according to FIG. 3 at the right side, there is provided a small rectangular plate 36 and a larger plate 37. These plates form a pivoting point for the piston rod eye 40. Both plates are welded to the longitudinal post 34, plate 37 reaching to the lower most horizontal girder 27 of the movable shuttering wall and welded together with it. For reinforcement there is welded another thin rectangular plate 38 onto the plate 37. A bolt 39 pierces through the plates and the eye 40 of the piston rod of the slide cylinder 41.

Figure 5:
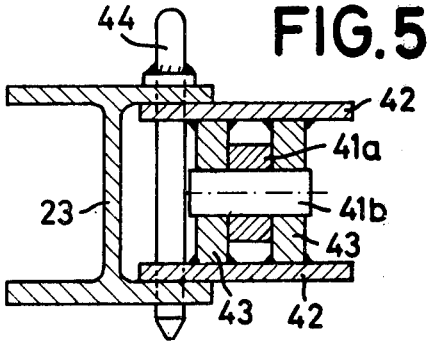
FIG. 5—Shows the slide cylinder end part taken along the line V—V of FIG. 4.
Figure 4:
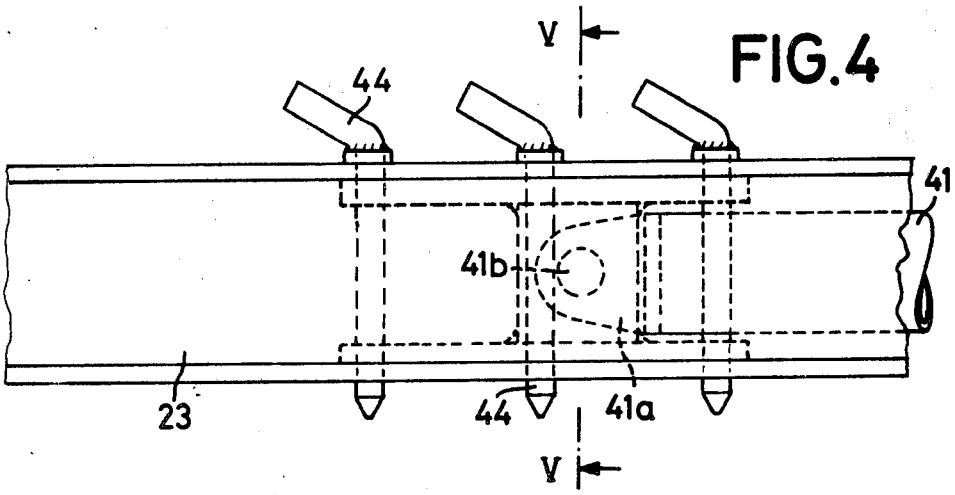
FIG. 4—Shows a slide sylinder end part of shuttering according to FIG. 2 in an appropriate view thereof.

The slide cylinder 41 acts on an end part shown in FIG. 4 and FIG. 5. This end part consists of two horizontal plates 42 which are connected with each other by means of two parallel eye plates 43 which stand vertically to them. Between the eye plates 43 lies the eye **41*a* of the slide cylinder 41. The appropriate bolt is marked with 41*b*. The distance of the horizontal plate 42 is chosen in such a way that they fit movable between the horizontal flanges of the transverse girder 23. Three bore-holes, each going through both horizontal plates 42 and several groups of such bore-holes in equal distances in the flanges of the transverse girder 23 enable it to fix the end part by choice at different places along the transverse girder 23 by means of three inserted vertical pins 44**.

Figure 6:
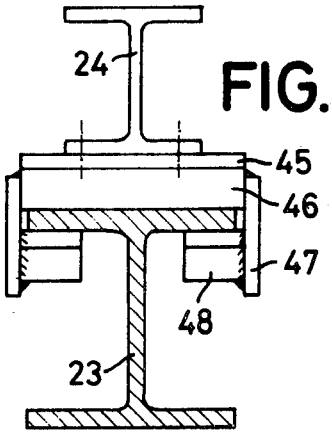
FIG. 6—Shows a guide assembly taken along line VI—VI of FIG. 2.

For guiding the slide skid 24 on the transverse girder 23 serves the guide piece shown in FIG. 2 and FIG. 6 It is screwed by means of four screws at the bottom flange of the slide skid 24 with an insert plate 46, sliding on the transverse girder 23, two guiding strips 47 welded laterally and two crowned fingers 48 which are fitted at the guiding strip 47 at the inside and seize underneath the upper flange of the transverse girder 23. These fingers 48 serve for the purpose, especailly when removing the shuttering, to avoid the lifting up of this support end of the slide skid 24 from the transverse girder 23. In the proximity of the clamping device there may be positioned also a guide piece of this kind shown. In the example there is provided within the ring frame of the clamping device where the largest pressure forces effect, only a slide plate 49.

Figure 7:
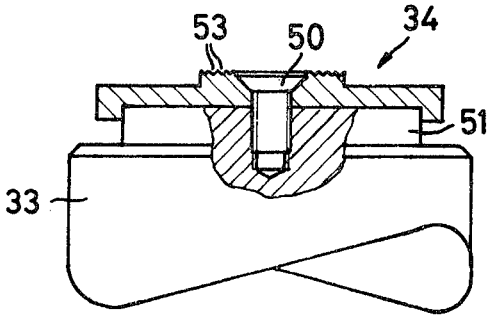
FIG. 7—Shows the pressure piece of the clamping cylinder in the intersection.
Figure 8:
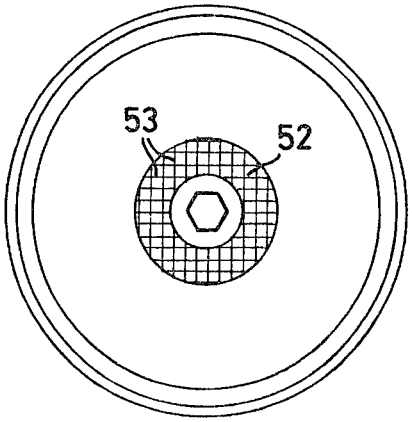
FIG. 8—Shows the pressure piece from above.

FIGS. 7 and 8 show in details the pressure piece 34 which is screwed by means of a central screw 50 onto the piston 51 of the clamping cylinder 33. Hereby it is to be noticed that the pressure piece 34 at first is not lying with its complete surface at the bottom surface of the transverse girder but only with a circular central area 52. This central area 52 is not even, but shows a net of longitudinally and cross running V-nuts 53 which are rectangular in section. These nuts practically join each other so that there are resuling jutting, pyramid-shaped points. The lifting force of the clamping cylinder 33 is sufficiently large that these points which consist of a hardened material press into the transverse girder 23.

In operation for removing the shuttering, the movable right shuttering wall is moved to the right side by means of the sliding cylinders 41, for which purpose the clamping device is opened in advance by retracting the clamping cylinder 33. After removing the finished binder 15, the shuttering wall is then driven back and clamped solidly with the basic frame, in the example according to FIG. 2 consequently with the transverse girders 23, that is so long until the concrete of the next binder has hardened. In order to adjust the shuttering walls exactly parallely when mounting the shuttering, respectively after a longer operation to compensate changes subject to wear and tear, the angle position of the movable shuttering wall is changed by means of exchanging the intermediate discs 45.

The stroke of the slide cylinder 41 is in any case sufficient for the sliding strokes necessary for removing the binder 15 out of shuttering. When the shuttering is set anew for another type of binder and if therefore the shuttering wall distance has to be changed beyond the stroke of the sliding cylinder, then the sliding cylinder is at first fully driven out or in, then the pins 44 are taken out and the end part 42,43 is driven to the adjacent anchor place, where the pins 44 are then put in again. This procedure may be repeated several times as needed.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed is:

1. Shuttering apparatus for forming precast concrete units especially of long dimension along a given axis comprising:

a horizontal basic frame having two shuttering walls of which at least one is a guided slidable shuttering wall selectively adjustable on transverse girders of the horizontal basic frame to change the mutual distance between the two shuttering walls;

piston and cylinder assembly means (16) for driving movements of the slidable shuttering wall and a plurality of clamping device means (19) on the slidable shuttering wall, each having a frame (30,31,32) surrounding a transverse girder (23) for slidable movement therealong and means on the frame for selectively pressing together the slidable shuttering wall (3) and the basic frame (1).

2. Shuttering apparatus according to claim 1, wherein the horizontal basic frame (1) comprises several parallel mounted ones of said transverse girders (4,23) having an I-beam profile;

said slidable shuttering wall (3,25,27,28,29) being provided with supports (11,26) mounted on horizontal sliding skids (13,24) connecting a lower edge of the slidable shuttering wall with the lower ends of the supports and;

the sliding skids (13,24) lie parallel up on the transverse girders (4,23) being guided along these girders slidably by means of fingers (48) disposed beneath and the upper transverse flanges of the transverse girders.

3. Shuttering apparatus according to claim 2 wherein one of said clamping device means (19,30 to 33) is provided for each of the sliding skids (13,24).

4. Shuttering apparatus according to claim 3 wherein each clamping device means (19, 30 to 33) is arranged near to an end of a sliding skid (13,24).

5. Shuttering apparatus according to claim 3 wherein a clamping device means comprises a frame means (30,31,32) surrounding a transverse girder (23) and a piston and cylinder assembly means having a short stroke, the piston of said piston and cylinder assembly means (51) comprising a pressure plate (34) for pressing against the transverse girder.

6. Shuttering apparatus according to claim 5 wherein the pressure plate (34) has an area (52) which is moulded in a relief shape pattern having projecting portions.

7. Shuttering apparatus according to claim 2 wherein the piston and cylinder assembly means (16,41) are mounted on the end portions at the transverse girders (23) for driving the slidable shuttering wall (3).

* * * * *